US007218316B2

(12) United States Patent
Ando

(10) Patent No.: US 7,218,316 B2
(45) Date of Patent: May 15, 2007

(54) IMAGE SIGNAL PROCESSING APPARATUS AND METHOD AND IMAGE DISPLAY APPARATUS AND METHOD

(75) Inventor: Muneki Ando, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 636 days.

(21) Appl. No.: 10/762,252

(22) Filed: Jan. 23, 2004

(65) Prior Publication Data

US 2004/0174353 A1 Sep. 9, 2004

(30) Foreign Application Priority Data

Mar. 4, 2003 (JP) ..... 2003-057693

(51) Int. Cl.
*G09G 3/30* (2006.01)

(52) U.S. Cl. ..... 345/204; 345/76; 345/82; 348/607; 315/169.3

(58) Field of Classification Search ..... 345/55–103, 345/204, 698–699, 208–210; 348/437.1, 348/438.1, 445–448, 607; 315/169.3
See application file for complete search history.

(56) References Cited

U.S. PATENT DOCUMENTS 4,602,273 A * 7/1986 Carlson ..... 348/450
5,091,784 A * 2/1992 Someya et al. ..... 348/589
5,388,081 A * 2/1995 Hashimoto et al. ..... 348/606
5,754,163 A * 5/1998 Kwon ..... 345/611
5,822,008 A * 10/1998 Inoue et al. ..... 348/446
6,107,983 A * 8/2000 Masuda et al. ..... 345/98
6,970,207 B1 * 11/2005 Seigneret et al. ..... 348/607
7,116,372 B2 * 10/2006 Kondo et al. ..... 348/448
2001/0040537 A1 * 11/2001 Sakai et al. ..... 345/55
2004/0125046 A1 * 7/2004 Yamazaki et al. ..... 345/1.3
2004/0160406 A1 * 8/2004 Yamazaki et al. ..... 345/100
2004/0179031 A1 * 9/2004 Ando ..... 345/698

FOREIGN PATENT DOCUMENTS

JP 63-306496 12/1988
JP 8-50462 2/1996

* cited by examiner

*Primary Examiner*—Lun-Yi Lao
(74) *Attorney, Agent, or Firm*—Fitzpatrick, Cella, Harper & Scinto

(57) ABSTRACT

To provide a bright, high-image-quality image display apparatus, in an overlap scanning mode in which two scan-wiring lines are selected simultaneously in each horizontal scanning period, high-frequency emphasis filtering is performed on a video signal so that a gain at a spatial frequency corresponding to ½ of a vertical critical resolution is within the range of 0 dB to +6 dB. It is even preferable that a gain of this high-frequency emphasis filtering at a spatial frequency corresponding to 7/10 of the vertical critical resolution be higher than or equal to +3 dB. For example, this high-frequency emphasis filtering can be implemented by a 3-tap FIR filter having filter coefficients (h1, h2, h3)=(−x/2, 1+x, −x/2).

9 Claims, 18 Drawing Sheets

IMAGE SIGNAL PROCESSING APPARATUS AND METHOD AND IMAGE DISPLAY APPARATUS AND METHOD

BACKGROUND OF THE INVENTION

1. Field of the Invention

The present invention relates to an image signal processing apparatus and method and an image display apparatus and method. In particular, the invention is suitably applied to various display apparatus such as EL displays, plasma displays, and electron beam emission type fluorescent displays.

2. Description of the Related Art

FIG. 15 shows the configuration of a conventional display apparatus, more specifically, a spontaneous light emission type image display apparatus having pixels each being a combination of an electron-emitting element and a light emitter (phosphor) that emits light as it receives electrons from the electron-emitting element.

The conventional display apparatus is mainly composed of a display panel 1, a scanning driving unit 2, a modulation driving unit 3, a sync separation unit 4, an AD converter 5, a control unit 6, and an image processing unit 7. The control unit 6 is a microcomputer, a logic circuit, or the like.

The display panel 1 displays an image using surface conduction electron-emitting elements. Row scan-wiring lines Dx1–Dxm and column modulation lines Dy1–Dyn are arranged in matrix form, and electron-emitting elements (not shown) are located at their crossing points. As such, the display panel 1 is equipped with m-row/n-column electron-emitting elements. Each electron-emitting element, which emits electrons while a current flows through it, has a nonlinear characteristic as shown in FIG. 16. For example, whereas electrons are emitted when a voltage 16 V is applied to the element, almost no electrons are emitted when a voltage 8 V is applied to it. Emitted electrons are accelerated by an accelerating means (not shown) and collide with a phosphor screen (not shown) to cause light emission. That is, although the element emits light when supplied with 16 V, it does not emit light when supplied with 8 V, that is, a half of the former voltage. Therefore, as shown in FIG. 17, this enables passive matrix driving.

The scanning driving unit 2 is composed of changeover switches 22, a selection potential generation unit 23, and a non-selection potential generation unit 24.

The modulation driving unit 3 is composed of a shift register 31, a latch 32, a pulse width modulation circuit 33, and a drive amplifier 34.

Reference symbol S1 denotes an analog video signal that is input to the apparatus. Reference symbol S2 denotes a sync signal that is separated from the analog video signal S1. Reference symbol S3 denotes a digital video signal obtained by sampling the analog video signal S1 with the AD converter 5. Reference symbol S4 denotes a display signal obtained by performing image processing on the digital video signal obtained S3. Reference symbol S5 denotes a conversion timing signal that is supplied to the AD converter 5. Reference symbol S6 denotes an image processing control signal to be used for controlling the signal processing unit 7. Reference symbol S7 denotes a video clock signal to be used for controlling the operation of the shift register 31. Reference symbol S8 denotes a modulation control signal to be used for controlling the operation of the modulation driving unit 3. Reference symbol S9 denotes a PWM clock as a reference of operation of the pulse width modulation circuit 33. Reference symbol S10 denotes a scanning control signal to be used for controlling the operation of the scanning driving unit 2.

The sync signal S2 that is extracted by the sync separation unit 4 from the analog video signal S1 that is input to the apparatus is input to the control unit 6.

The control unit 6 generates the control signals S5–S10 on the basis of the sync signal S2.

The AD converter 5 samples the analog video signal S1 according to the conversion timing signal S5 and outputs the digital video signal S3.

The image processing unit 7 input the digital video signal S3 performs image processing such as image adjustments and a resolution conversion on the digital video signal S3, and outputs the display signal S4.

The operation that the scanning driving unit 2 and the modulation driving unit 3 drive the display panel 1 will be described below. FIG. 18 shows timing of this operation.

In the modulation driving unit 3, data of the display signal S4 are sequentially input to the shift register 13 in synchronism with the video clock signal S7 and display data are held by the latch 14 in response to a LOAD signal of the modulation control signal S8. The pulse width modulation circuit 33 generates pulse signals whose lengths correspond to the data that are held by the latch 32 using the PWM clock S9 as a reference in response to a START signal of the modulation control signal S8. The voltage of the pulse signals is amplified to Vm by the drive amplifier 34 and the modulation lines Dy1–Dyn of the display panel 1 are driven by the amplified pulse signals.

With the above operation, the content of the input video signal S1 is displayed on the display panel 1.

OBJECT AND SUMMARY OF THE INVENTION

In general, bright pictures are preferred in image display apparatus, particularly in consumer apparatus. However, in consumer apparatus, the cost requirement is always high and hence it is always necessary to reduce the cost. On the other hand, the quality of a displayed image, particularly the sharpness, is an important factor as a index of the performance of an image display apparatus.

The present invention has been made in view of the above circumstances, and an object of the present invention is therefore to provide a bright, high-image-quality image display apparatus at a low cost.

To attain the above object, the present invention employs the following means.

A first aspect of the present invention provides an image signal processing apparatus to be used for an image display apparatus provided with a display panel having scan-wiring lines, modulation lines, and display elements that are driven via the scan-wiring lines and modulation lines; a scanning circuit for supplying scanning signals to the scan-wiring lines according to such a scanning method as to select a plurality of adjoining scan-wiring lines simultaneously in each selection period while changing the set of scan-wiring lines to be selected simultaneously so that the same scan-wiring line is selected two or more times in each frame; and a modulation circuit for supplying modulation signals to the modulation lines, wherein the image signal processing apparatus comprises filter means for performing, on received image data, signal processing for compensating for a reduction in resolution in a vertical scanning direction that is caused by the scanning method of the scanning circuit, and for supplying resulting image data to the modulation circuit; and a normalized vertical spatial frequency response characteristic of the filter means satisfies 0 dB<G1≦+6 dB, where G1 is a gain at a spatial frequency corresponding to ½ of a vertical critical resolution of the display panel.

In the first aspect of the present invention, it is preferable that the normalized vertical spatial frequency response characteristic of the filter means satisfies G2≧+3 dB, where G2 is a gain at a spatial frequency corresponding to 7/10 of the vertical critical resolution of the display panel.

A second aspect of the present invention provides an image display apparatus comprising a display panel having scan-wiring lines, modulation lines, and display elements that are driven via the scan-wiring lines and modulation lines; a scanning circuit for supplying scanning signals to the scan-wiring lines according to such a scanning method as to select a plurality of adjoining scan-wiring lines simultaneously in each selection period while changing the set of scan-wiring lines to be selected simultaneously so that the same scan-wiring line is selected two or more times in each frame; a modulation circuit for supplying modulation signals to the modulation lines; and filter means for performing, on received image data, signal processing for compensating for a reduction in resolution in a vertical scanning direction that is caused by the scanning method of the scanning circuit, and for supplying resulting image data to the modulation circuit, wherein a normalized vertical spatial frequency response characteristic of the image display apparatus satisfies −3 dB<R1≦+3 dB, where R1 is a response at a spatial frequency corresponding to ½ of a vertical critical resolution of the display panel.

In the second aspect of the present invention, it is preferable that the display panel comprise electron-emitting elements as display elements located at crossing points of the scan-wiring lines and the modulation lines, and a phosphor that emits light when electrons emitted from the electron-emitting elements collide with it. Moreover, the electron-emitting elements may be selected from various kinds such as FE electron-emitting elements. It is particularly preferable that the electron-emitting elements be surface conduction electron-emitting elements.

A third aspect of the invention provides an image signal processing method for processing image signals to be supplied to an image display apparatus having a modulation circuit for supplying modulation signals to modulation lines of a display panel and a scanning circuit for supplying scanning signals to scan-wiring lines of the display panel in such a manner as to select a plurality of adjoining scan-wiring lines simultaneously in each selection period while changing the set of scan-wiring lines to be selected simultaneously so that the same scan-wiring line is selected two or more times in each frame, the image signal processing method comprising a filtering step of performing, on received image data, signal processing for compensating for a reduction in resolution in a vertical scanning direction that is caused by the scanning circuit, and supplying resulting image data to the modulation circuit, wherein a normalized vertical spatial frequency response characteristic of the filtering step satisfies 0 dB<G1≦+6 dB, where G1 is a gain at a spatial frequency corresponding to ½ of a vertical critical resolution of the display panel.

In the third aspect of the invention, it is preferable that the normalized vertical spatial frequency response characteristic of the filtering step satisfy G2≧+3 dB, where G2 is a gain at a spatial frequency corresponding to 7/10 of the vertical critical resolution of the display panel.

A fourth aspect of the invention provides an image display method using an image display apparatus having a scanning circuit for supplying scanning signals to scan-wiring lines of a display panel and a modulation circuit for supplying modulation signals to modulation lines of the display panel, the image display method comprising a scanning step of causing the scanning circuit to select a plurality of adjoining scan-wiring lines simultaneously in each selection period while changing the set of scan-wiring lines to be selected simultaneously so that the same scan-wiring line is selected two or more times in each frame; and a filtering step of performing, on received image data, signal processing for compensating for a reduction in resolution in a vertical scanning direction that is caused by the scanning step, and supplying resulting image data to the modulation circuit, wherein a normalized vertical spatial frequency response characteristic of the image display apparatus satisfies −3 dB<R1≦+3 dB, where R1 is a response at a spatial frequency corresponding to ½ of a vertical critical resolution of the display panel.

DETAILED DESCRIPTION OF THE INVENTION

(Embodiment 1)

Figure 1:
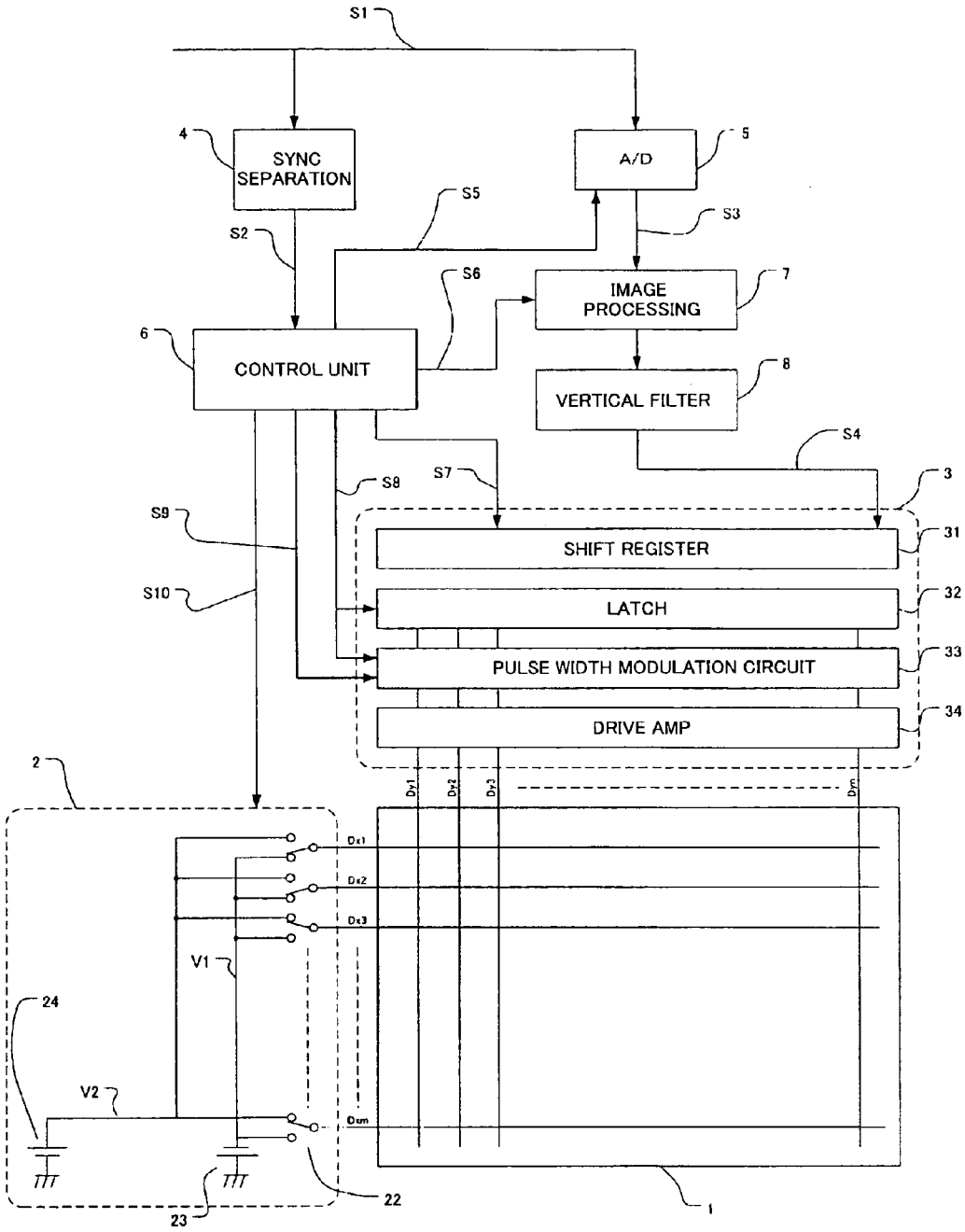
FIG. 1 is a block diagram showing the configuration of a display apparatus according to the present invention.

FIG. 1 shows the configuration of an image display apparatus according to a first embodiment of the present invention.

Figure 15:
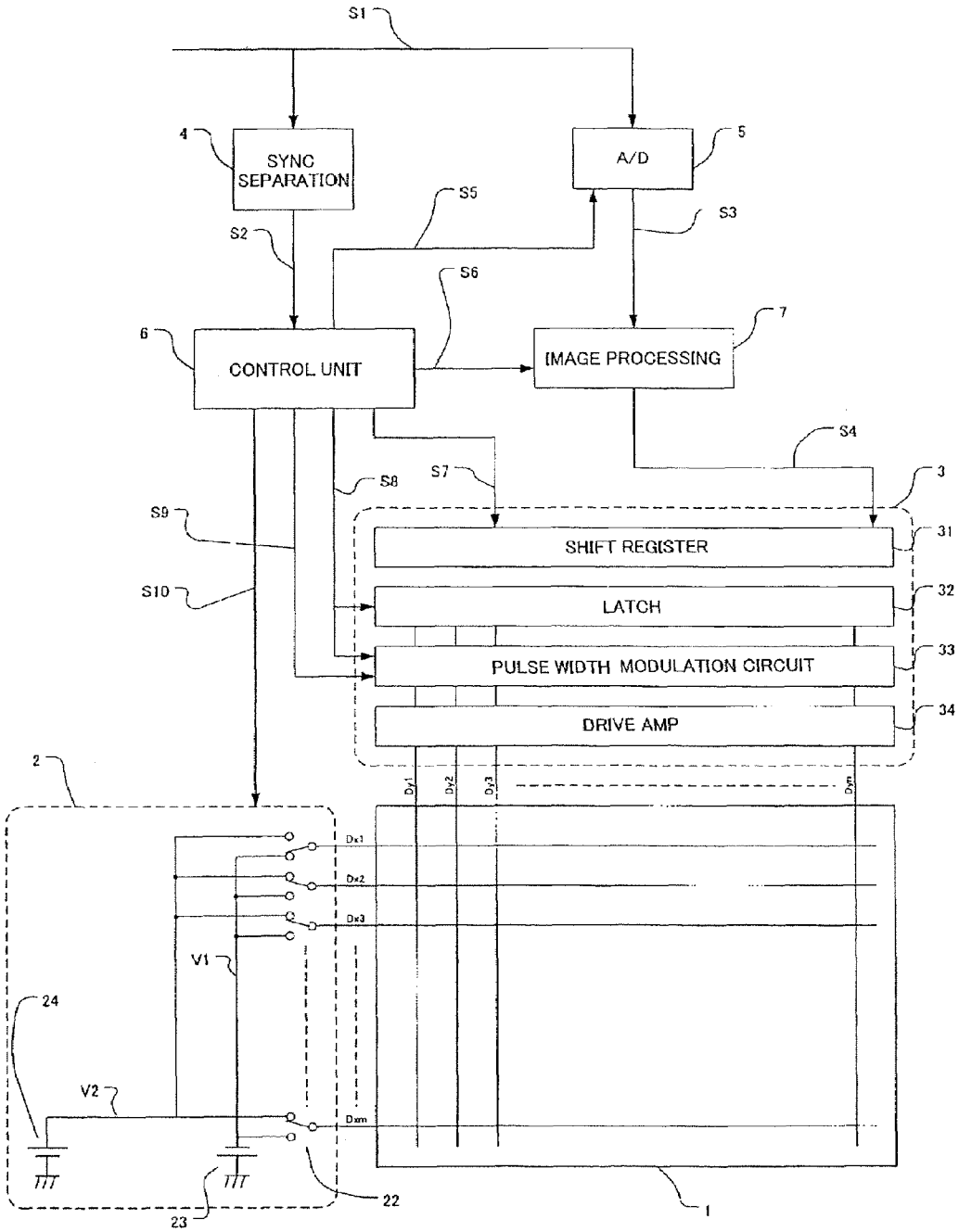
Fig.15 (PRIOR ART)
FIG. 15 is a block diagram of a conventional display apparatus.
Figure 16:
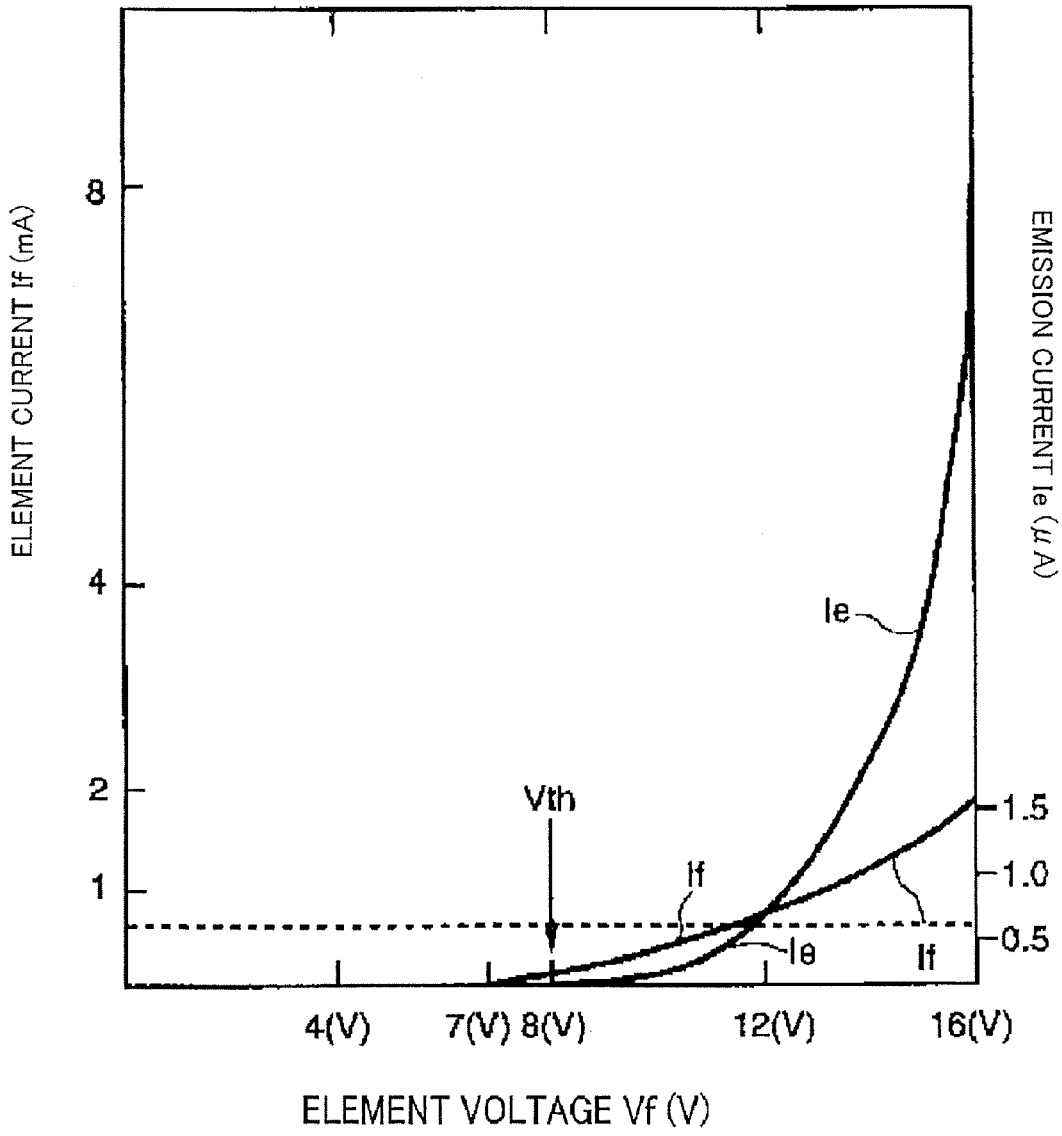
Fig.16 (PRIOR ART)
FIG. 16 is a graph showing a characteristic of an electron-emitting element.
Figure 17:
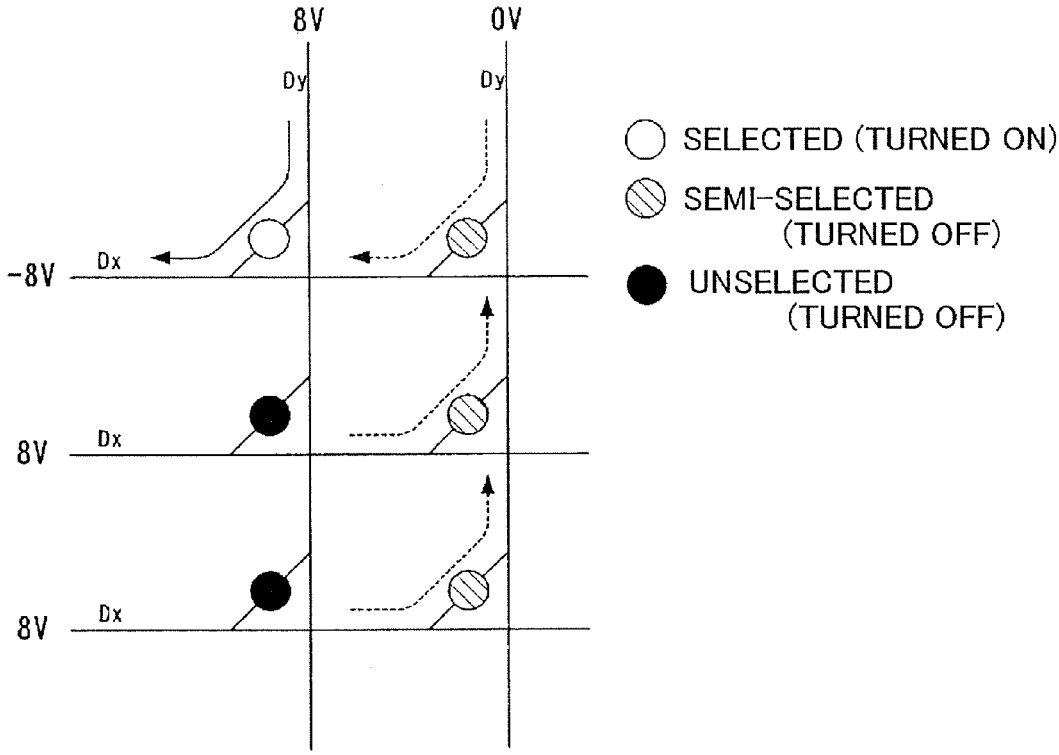
Fig.17 (PRIOR ART)
FIG. 17 is a schematic diagram illustrating passive matrix driving.
Figure 18:
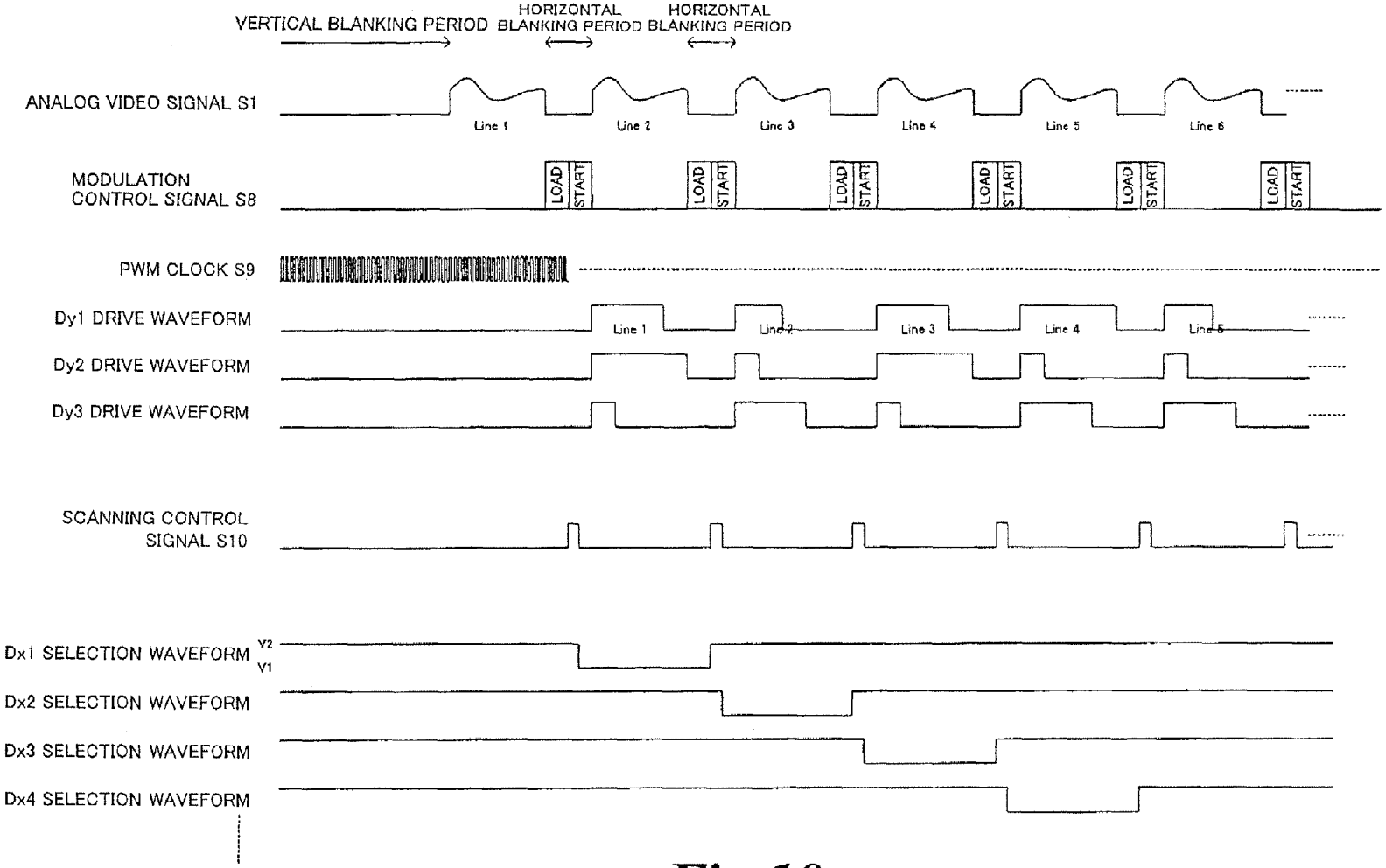
Fig. 18 (PRIOR ART)
FIG. 18 is a conventional timing chart.

The image display apparatus is mainly composed of a display panel 1, a scanning driving unit 2, a modulation driving unit 3, a sync separation unit 4, an AD converter 5, a control unit 6, an image processing unit 7, and a vertical filter unit 8. Components and signals in FIG. 1 having the same components and signals in the conventional image display apparatus of FIG. 15 are given the same reference symbols as the latter and will not be described. In this embodiment, the electron-emitting element of the display panel 1 may be a surface conduction electron-emitting element, an FE electron-emitting element, an MIM electron-emitting element, or some other proper electron-emitting element. The structure of each pixel is not limited to a combination of the electron-emitting element and a light emitter (phosphor) that emits light as it receives electrons from the electron-emitting element. That is, the display panel 1 may also be an organic EL device, an inorganic EL device, a plasma light-emitting device, or the like.

The vertical filter unit 8 as a filter means performs filtering processing (described later) on a signal that is output from the image processing unit 7, and outputs a resulting signal as a display signal S4.

Figure 2:
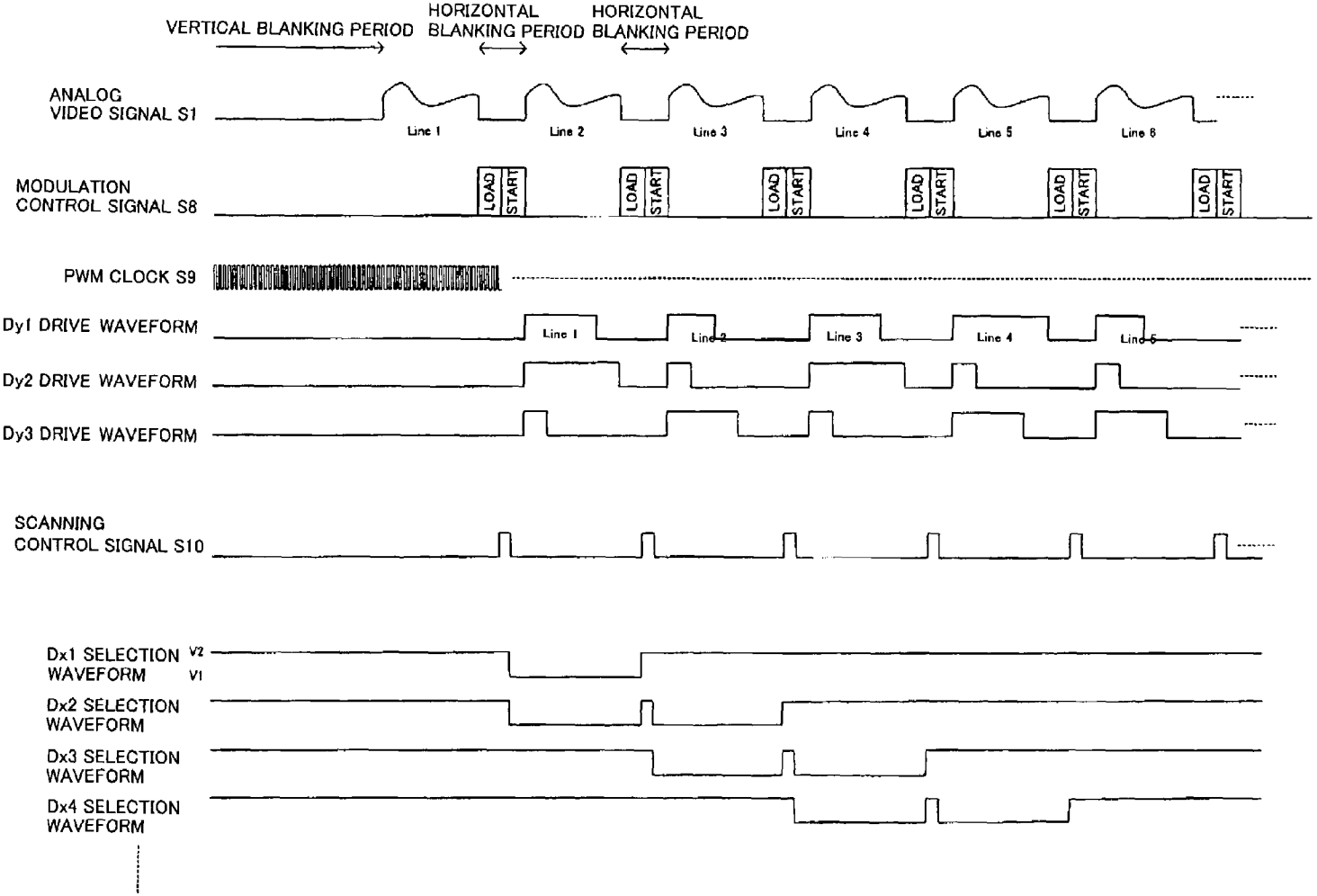
FIG. 2 is a timing chart of overlap scanning according to the present invention.

A driving method of the display panel 1 may be such that two (or more) of the scan-wiring lines Dx1–Dxm are rendered active (i.e., selected) simultaneously, whereby two pixels that are located on the two scan-wiring lines and belong to the same column receive the same drive voltage pulse and emit light. This makes it possible to increase the luminance of an image displayed on the display panel 1. FIG. 2 shows timing for such driving. In a first horizontal scanning period, a scanning selection potential V1 is supplied to the scan-wiring lines Dx1 and Dx2 simultaneously. Therefore, the pixels corresponding to two scan-wiring lines are enabled to emit light simultaneously. A scanning non-selection potential V2 is temporarily supplied to all the scan-wiring lines Dx1–Dxm and the same potential is supplied to all the modulation lines Dy1–Dyn, whereby the voltage applied to the electron-emitting element of every pixel is set zero temporarily. In the next horizontal scanning period, the scanning selection potential V1 is supplied to the scan-wiring lines Dx2 and Dx3 simultaneously and pixels corresponding to two scan-wiring lines are enabled to emit light simultaneously. The same operation will be repeated thereafter.

The driving is performed in such a manner that each scan-wiring line Dxm is rendered active in two consecutive horizontal scanning periods and two scan-wiring lines are selected simultaneously in each horizontal scanning period. This makes it possible to almost double the luminance of an image displayed on the display panel 1. This driving method, that is, a scanning method in which a plurality of adjoining scan-wiring lines are selected simultaneously in each selection period and the set of scan-wiring lines that are selected simultaneously is changed over time, whereby the same scan-wiring line is selected two or more times in each frame, will be referred to below as "overlap scanning mode."

Since as is understood from the above description the overlap scanning mode can be realized merely by changing the operation timing of the scanning driving unit 2 as the scanning circuit of an ordinary image display apparatus, it can remarkably increase the display luminance of an image display apparatus at a low cost.

On the other hand, it is known intuitively and empirically that the overlap scanning mode is associated with a problem that the vertical resolution of a displayed image lowers. However, it has been so far unclear what specific display characteristic the overlap scanning mode provides.

The inventor studied the display characteristic of the overlap scanning mode and have revealed it. Results of the study will be described below.

Figure 3:
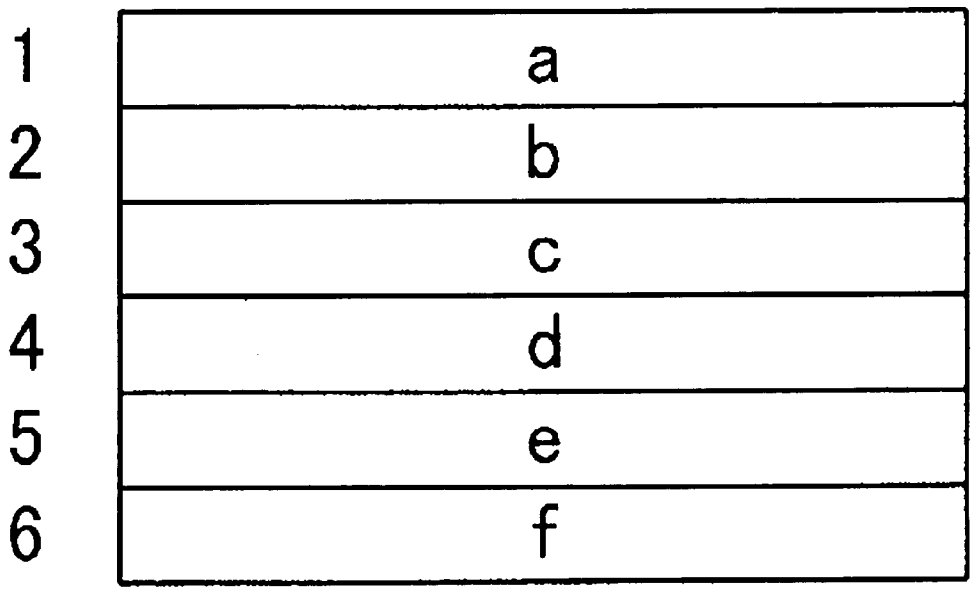
FIG. 3 is a conceptual chart of a conventional driving method.

FIG. 3 is a conceptual chart of a display in a case that the display panel 1 is driven by an ordinary scanning method. Numbers 1–6 denote individual scanning lines and characters a–f denote 1-line video signals corresponding to the respective scanning lines 1–6.

Figure 4:
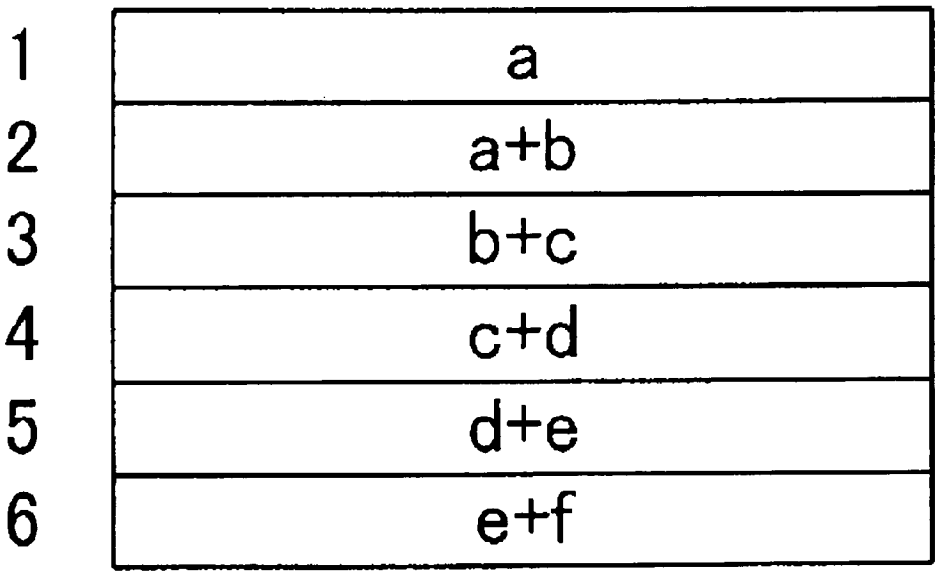
FIG. 4 is a conceptual chart of an overlap scanning mode.

FIG. 4 shows a display in a case that the display panel 1 is driven in the overlap scanning mode by using the same original video signal as in the case of FIG. 3. The video signals a and b are sequentially used for display on the second line and the video signals b and c are sequentially used for display on the third line. It is seen that the constituent elements of each scanning line of the ordinary scanning method also appear on the scanning line immediately thereunder. The fact that each element also appears in an interval that is delayed by one unit time is equivalent to execution of low-pass filtering having an impulse response (1, 1) in the vertical direction. Therefore, for example, the overlap scanning mode provides a vertical spatial frequency response characteristic shown in FIG. 5 in the case of a display panel having 720 vertical scanning lines.

Figure 6:
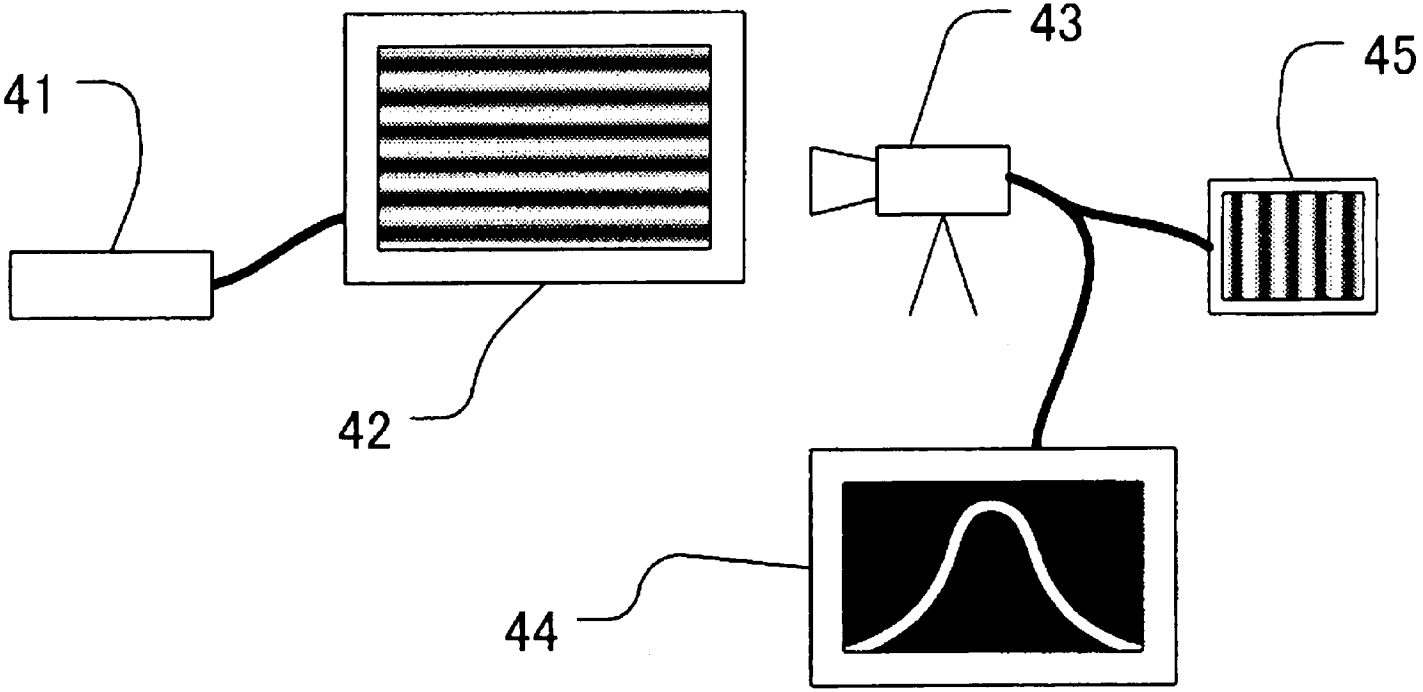
FIG. 6 shows a measurement system of a vertical spatial frequency response characteristic.

A vertical resolution of a display panel was measured. FIG. 6 is a conceptual diagram of a measurement system of a vertical spatial frequency response characteristic of a panel. The measurement system is composed of a signal generator 41, a panel 42 to be measured, a video camera 43, a spectrum analyzer 44, and an observation monitor 45.

Figure 7:
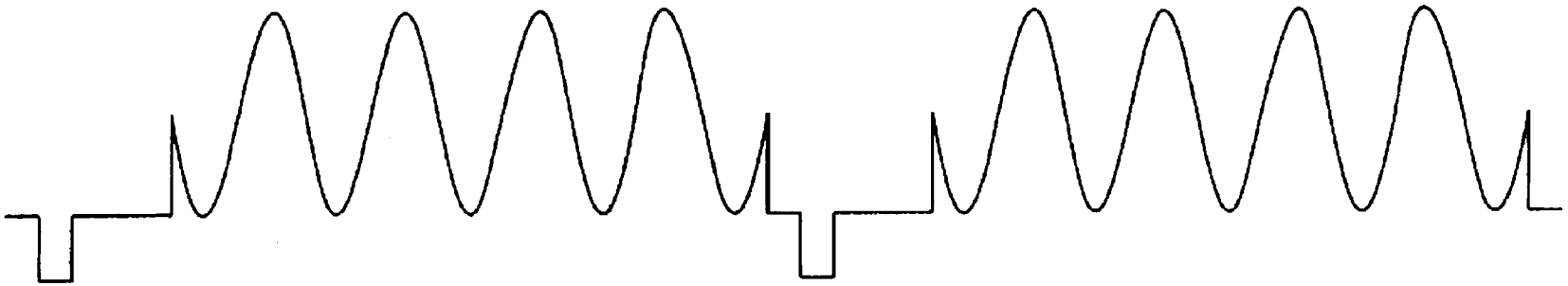
FIG. 7 shows an exemplary signal waveform produced by the measurement system of FIG. 6.

A vertically periodic waveform (i.e., horizontal stripes) generated by the signal generator 41 is displayed on the panel 42 to be measured and a displayed image is shot by the video camera 43. At this time, the video camera 43 is set so as to be inclined laterally by 90° from the normal posture. As a result, for example, the video camera 43 produces a video signal having a horizontal periodic waveform (i.e., vertical stripes) as shown in FIG. 7. This signal is observed by the spectrum analyzer 44, whereby a spectrum corresponding to the periodic signal generated by the signal generator 41 is obtained. A peak level of the spectrum is employed as a response corresponding to the spatial frequency generated by the signal generator 41. A vertical spatial frequency response characteristic of the panel 42 to be measured is obtained by sweeping the generation frequency of the signal generator 41 and plotting results.

Figure 5:
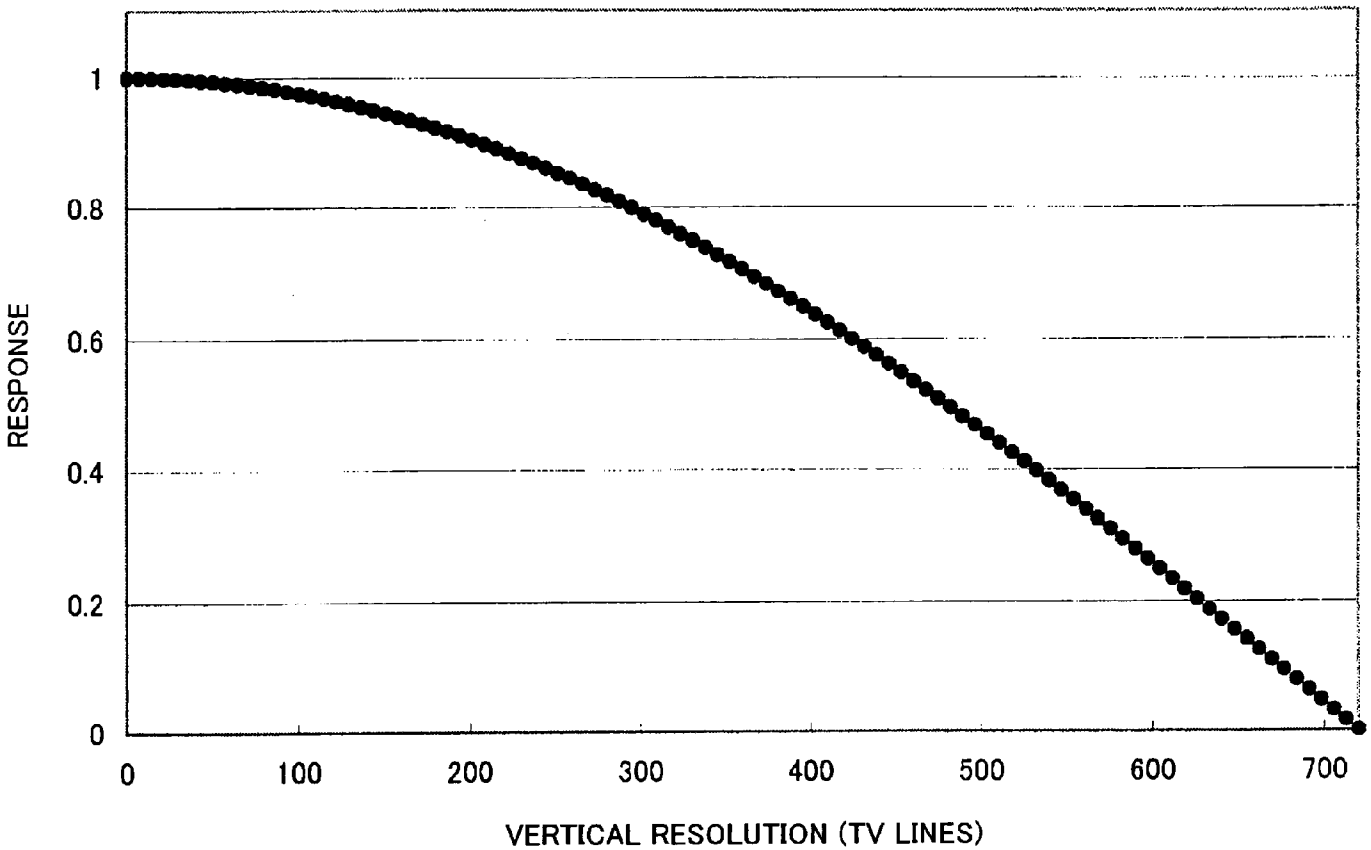
FIG. 5 is a graph of a calculated vertical spatial frequency response characteristic of the overlap scanning mode.
Figure 8:
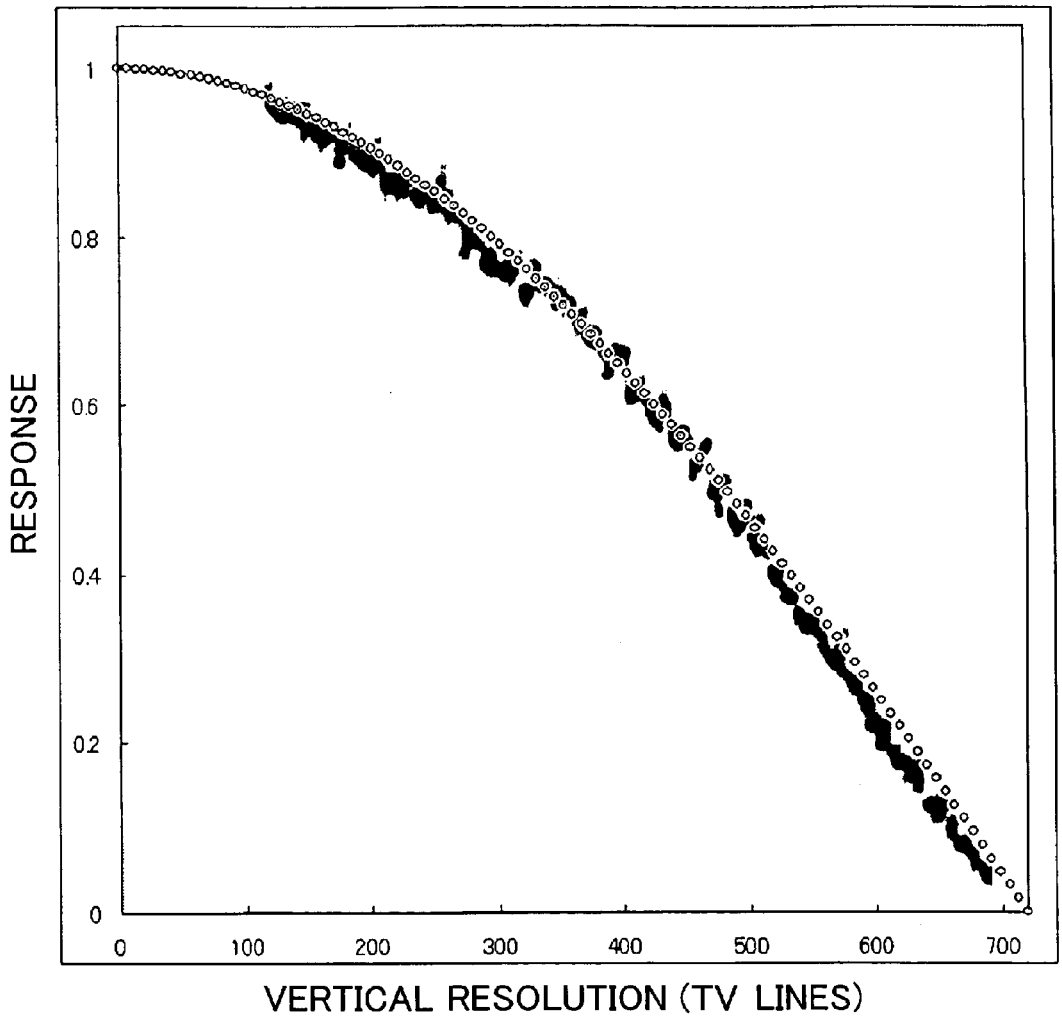
FIG. 8 is a graph showing calculated and measured vertical spatial frequency response characteristics of the overlap scanning mode.

FIG. 8 compares a vertical spatial frequency response characteristic thus measured with the calculated characteristic of FIG. 5: a good agreement is found.

It is concluded from the above measurement result that the overlap scanning mode provides a vertical spatial frequency response characteristic that is equivalent to the characteristic of a vertical filter having an impulse response (1, 1).

It is considered possible to compensate for deterioration in vertical resolution of the overlap scanning mode by means of signal processing as in the case of an aperture correction circuit for a CRT. However, it is difficult to perform optimum compensation unless a display characteristic is known. Designing of an optimum compensation circuit is now possible because the invention has revealed the display characteristic of the overlap scanning mode.

A designing method of a compensation filter that is implemented as the vertical filter 8 will be described below.

Spatial frequencies around ½ of a vertical critical resolution have large visual influence on the sharpness. It is therefore desirable that a compensated display characteristic be flat in this frequency range. Results of subjective evaluations etc. have shown that a good display state can be obtained if the response of a display panel with respect to a video signal is within ±3 dB in a vertical resolution range of 0 TV line to ½ of the vertical critical resolution.

Where no compensation is made, the vertical spatial frequency response characteristic of the overlap scanning mode is such that the response at the spatial frequency corresponding ½ of the vertical critical resolution is −3 dB. That is, a good display state in which the response at the spatial frequency corresponding to ½ of the vertical critical resolution is within ±3 dB can be obtained by subjecting a video signal to high-frequency emphasis filtering in which the gain at the spatial frequency corresponding to that resolution is 0 dB to +6 dB.

It has also been found that an even preferable display state can be obtained if the gain of the high-frequency emphasis filter at the spatial frequency corresponding to 7/10 of the vertical critical resolution is +3 dB or higher.

Figure 9:
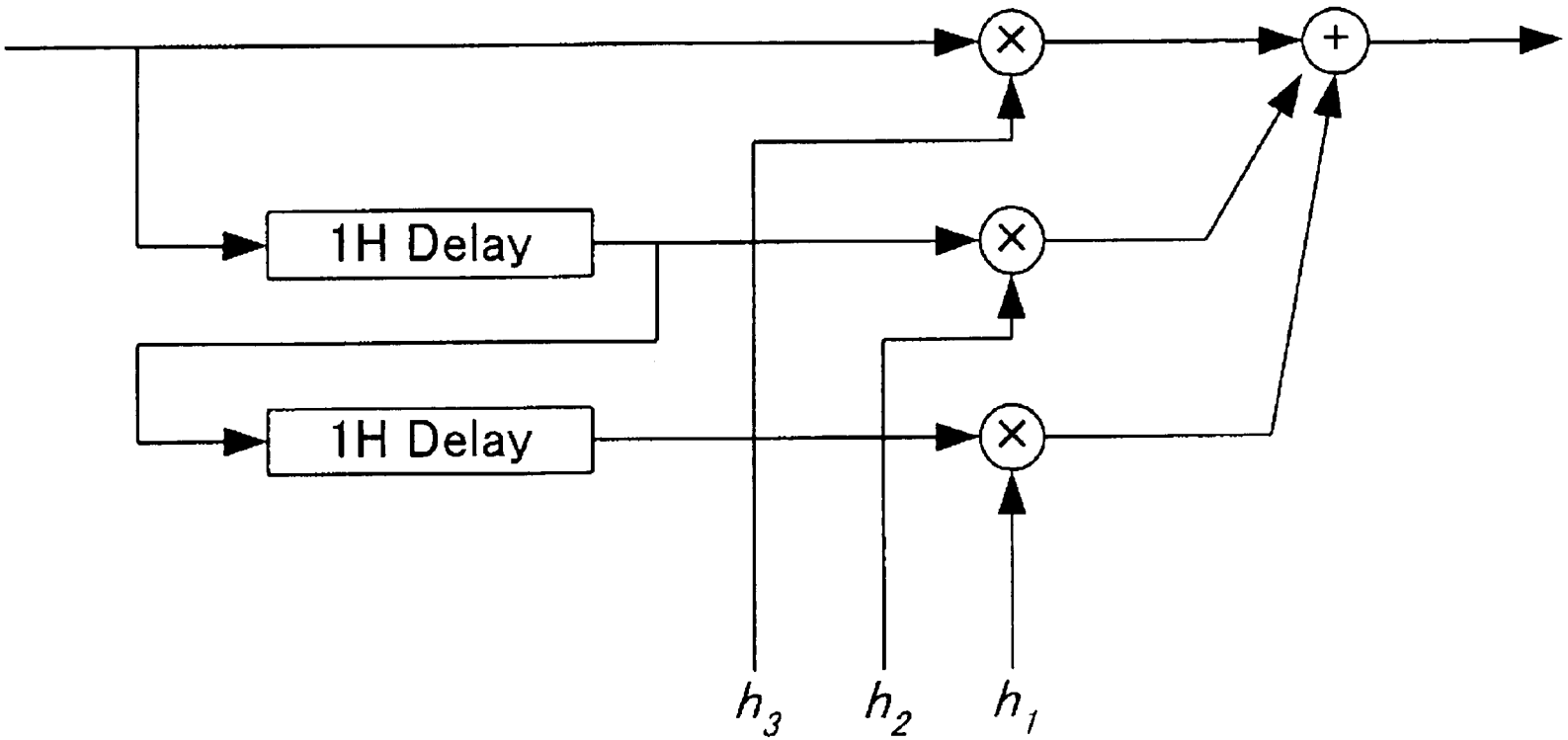
FIG. 9 shows the configuration of a 3-tap vertical filter.

As for a specific circuit configuration of the vertical filter 8 that is used as a filter means according to the invention, that is, a high-frequency emphasis filter, a 3-tap FIR (finite impulse response) filter having a small hardware scale (see FIG. 9) is preferable. In this filter, image data for a certain pixel, image data for another pixel obtained by delaying the above image data by one horizontal scanning period, and image data for still another pixel that is obtained by delaying the first image data by two horizontal scanning periods are multiplied by filter coefficients (impulse response) Hn=(h1, h2, h3) and resulting data are added together. Naturally, an addition result is subjected to normalization processing if necessary. That is, a characteristic of the above-mentioned high-frequency emphasis filter can be determined by using the filter shown in FIG. 9 and setting its filter coefficients properly.

Figure 10:
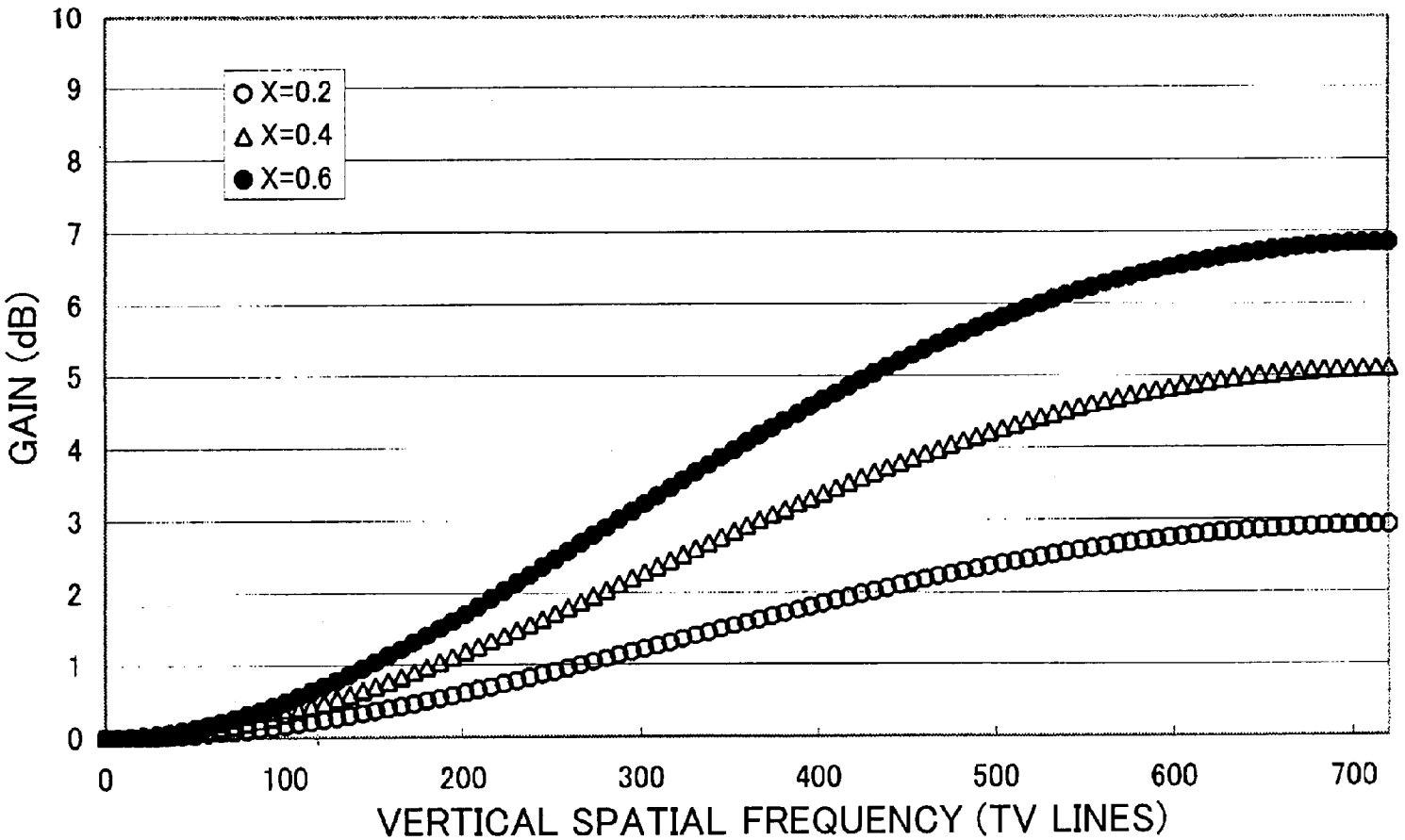
FIG. 10 is a graph showing characteristics of exemplary 3-tap vertical filters.

A 3-tap high-frequency emphasis filter is expressed by an impulse response Hn=(−x/2, 1+x, −x/2). The three coefficients of filters that are suitable for the overlap scanning mode compensation are (−0.1, 1.2, −0.1) where x=0.2, (−0.2, 1.4, −0.2) where x=0.4, (−0.3, 1.6, −0.3) where x=0.6, or the like. FIG. 10 shows frequency characteristics of these three filters.

More specifically, assume that pixel data of a certain pixel is represented by b and two pixel data that lead and lag that pixel data by one horizontal scanning period are represented by a and c, respectively, and the filter coefficients are (−0.1, 1.2, and −0.1), filtered and normalized pixel data b' is given by b'=−0.1a+1.2b−0.1c.

In each of the above three filters, the gain at the spatial frequency corresponding to ½ (i.e., 360) of the vertical critical resolution (720) is within the range of 0 dB to +6 dB. Further, in each of the filters having the respective x values 0.4 and 0.6, the gain at the spatial frequency corresponding to 7/10 of the vertical critical resolution is larger than +3 dB.

Figure 11:
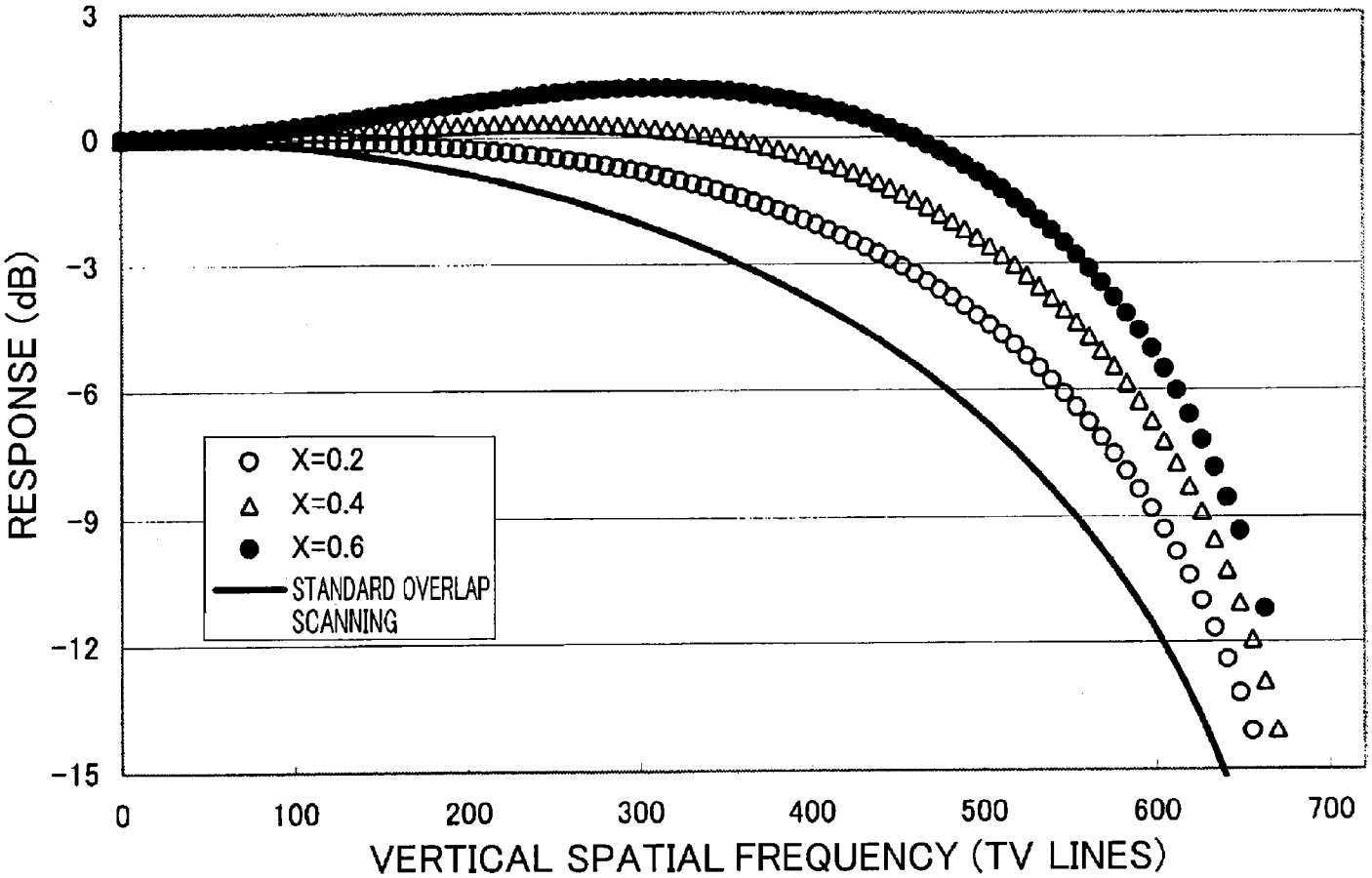
FIG. 11 is a graph showing vertical spatial frequency response characteristics of the overlap scanning mode as compensated by using the 3-tap filters of FIG. 10.

FIG. 11 shows vertical spatial frequency response characteristics of the overlap scanning mode as compensated by using the above filters. It is seen that the response at the spatial frequency corresponding to ½ of the vertical critical resolution is within ±3 dB and the characteristics are better than without compensation.

The user may properly determine the filter coefficients in the above-described setting ranges so as to provide a spatial frequency response characteristic in the above-described range. The filter coefficients may be set in advance in the form of values stored in a storage means such as a ROM or a register of the control unit 6.

Embodiment 2

Although the 3-tap vertical filter used as the compensation filter in the first embodiment is small in the amount of hardware and can be implemented easily, it has a problem that the degree of freedom in designing the characteristic is low. For example, if it is attempted to compensate the response at the spatial frequency corresponding to 7/10 of the vertical critical resolution, the response at the spatial frequency corresponding to ½ of the vertical critical resolution is influenced by the former compensation and thereby over-compensated. The present invention can even be applied to a high-accuracy application in which such a phenomenon is problematic, by using a higher order filter.

Figure 12:
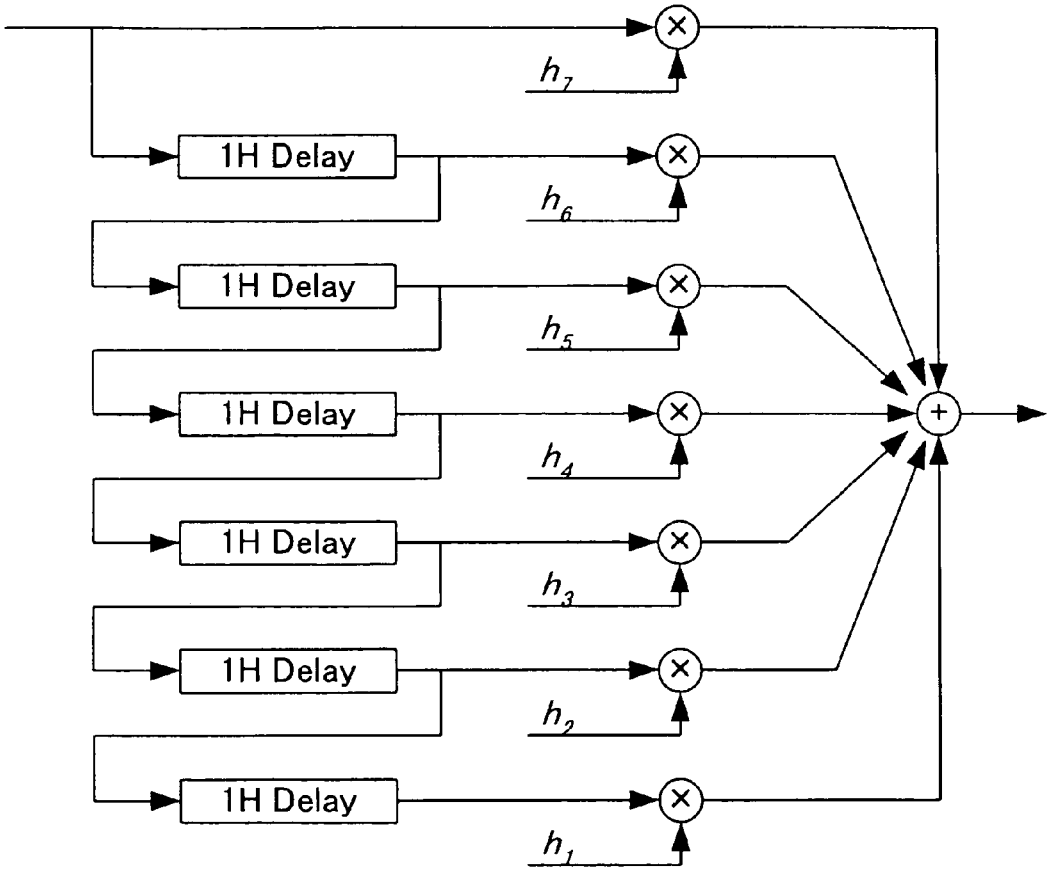
FIG. 12 is a schematic diagram illustrating the configuration of a 7-tap vertical filter.
Figure 13:
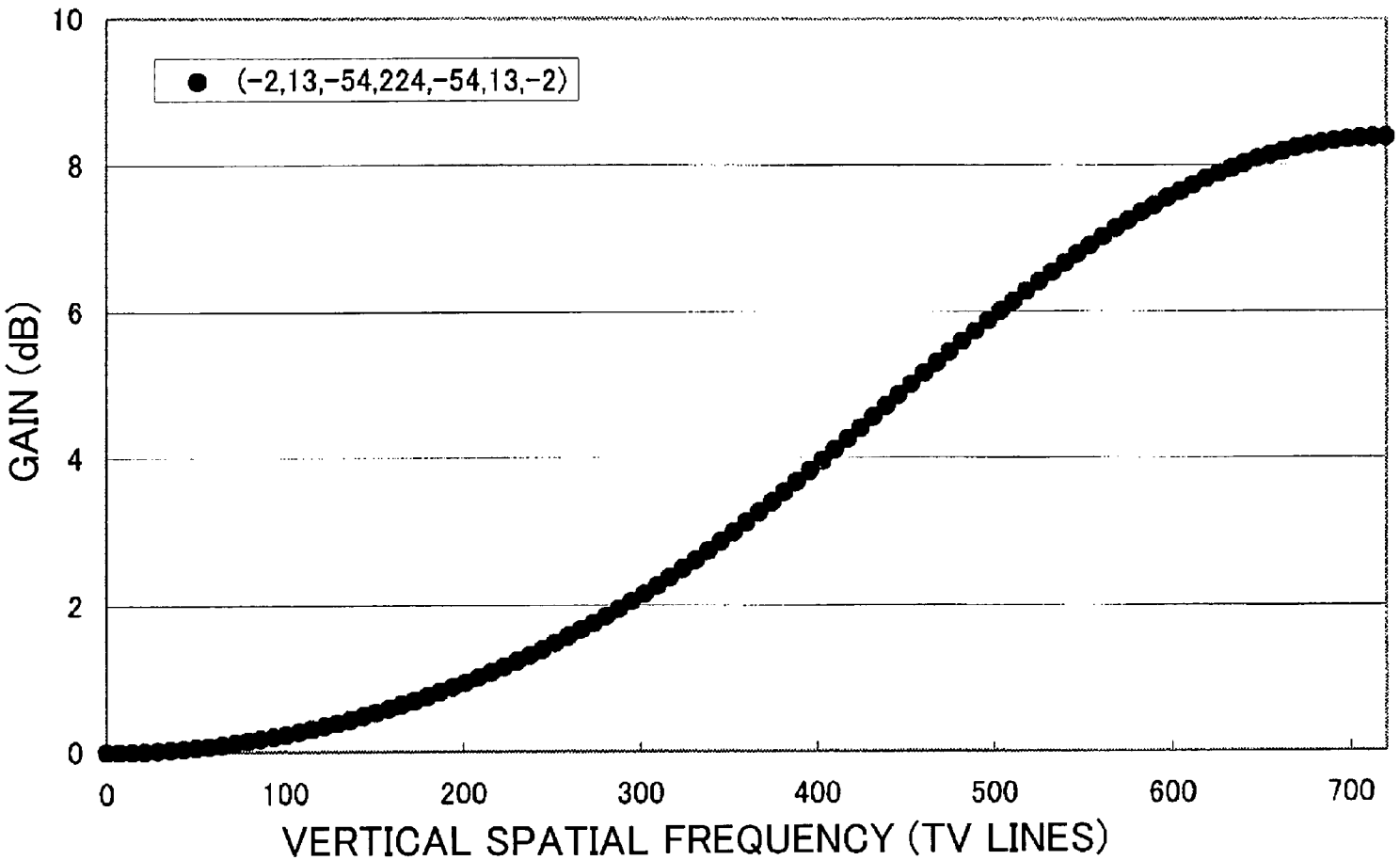
FIG. 13 is a graph showing a characteristic of an exemplary 7-tap vertical filter.
Figure 14:
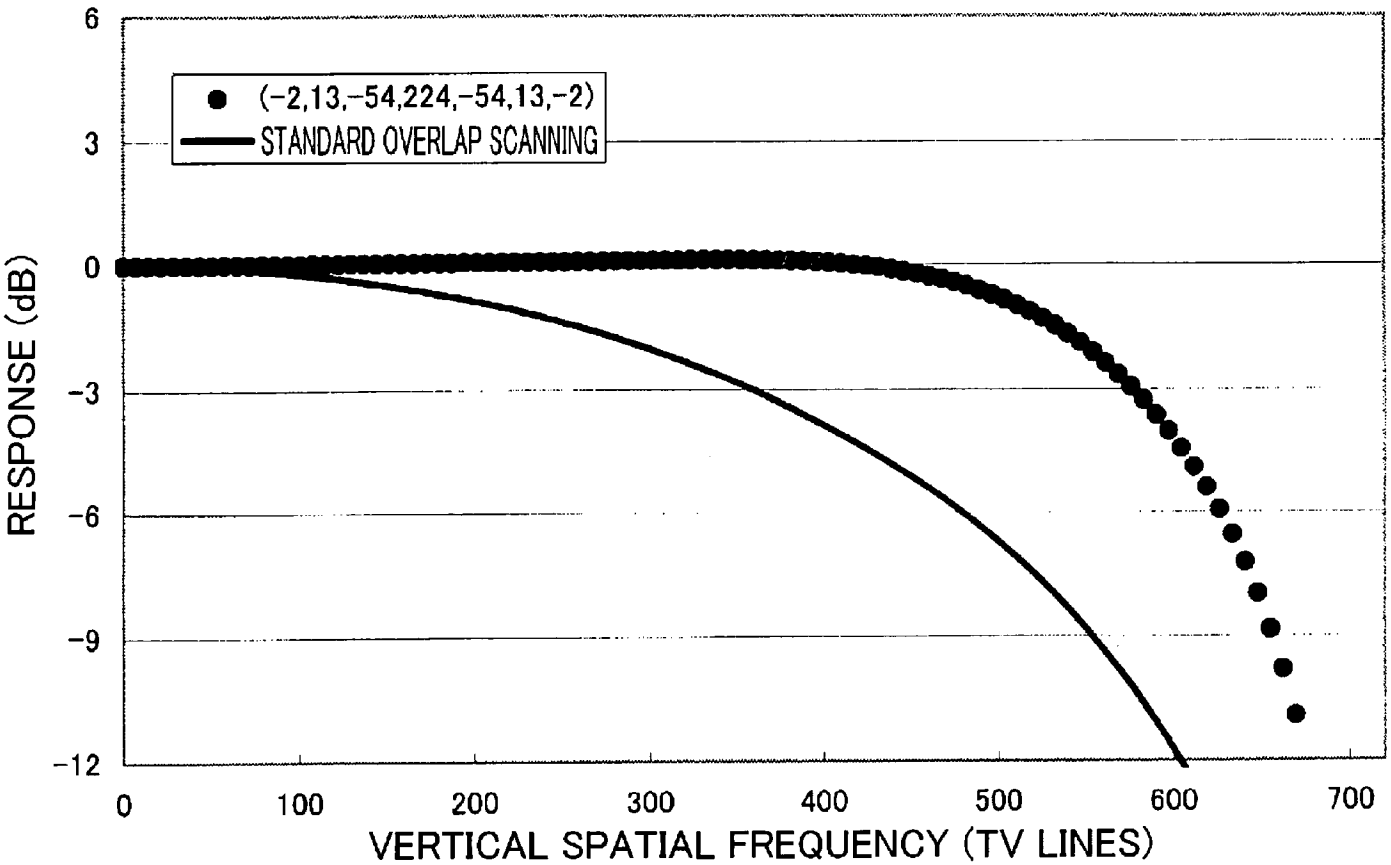
FIG. 14 is a graph showing a vertical spatial frequency response characteristic of the overlap scanning mode as compensated by using the 7-tap filter of FIG. 13.

FIG. 12 shows the configuration of a 7-tap vertical filter. For example, a filter that is configured as shown in FIG. 12 and has filter coefficients Hn=(−2, 13, −54, 224, −54, 13, −2) is given a frequency characteristic shown in FIG. 13. FIG. 14 shows a spatial frequency response characteristic of the overlap scanning mode as compensated by using this filter. It is seen that this spatial frequency characteristic is flatter than in the first embodiment.

The use of a 7th order filter as a compensation filter enables higher accuracy compensation though the compensation hardware becomes more complex. Except for the filter unit, the apparatus has the same configuration as in the first embodiment.

Although the filter coefficients Hn=(−2, 13, −54, 224, −54, 13, −2) were mentioned above as exemplary filter coefficients, the present invention can similarly be implemented by using filters having different coefficients.

The present invention can be implemented without the need for restricting the details of the filter; that is, the present invention can similarly be implemented by using filters that are different in configuration than the filters described in the embodiments. Examples of filters that are different in configuration are a 5th order filter, a 9th or even higher order filter, an even-numbered order filter, and an IIR (infinite impulse response) filter.

The general design theory of the filter used in the present invention is known from, for example, "Easy-to-Understand Digital Image Processing," CQ Publishing Co., Ltd., third edition published on Aug. 30, 1997.

The above embodiments are directed to the overlap scanning mode in which, as shown in FIG. 4, in each vertical scanning period, a first line and a second line (two lines) are selected simultaneously in a first selection period and the second line (selected in the first selection period) and a third line (not selected in the first selection period) are selected simultaneously in the next selection period.

However, the present invention is not limited this method and the following overlap scanning mode may be employed. Each frame is divided into two vertical scanning periods (i.e., two field scanning periods). In the first field, a first line and a second line (two lines) are selected simultaneously in a first selection period and a third line and a fourth line (both not selected in the first selection period) are selected simultaneously in the next selection period. In the second field, the second line and the third line (two lines) are selected simultaneously in a first selection period and the fourth line and a fifth line are selected simultaneously in the next selection period.

That is, the overlap of scanning lines may occur in horizontal scanning periods that are either consecutive or not consecutive in time; a satisfactory result can be obtained as long as overlap occurs in each frame as a result.

Although the embodiments are directed to the display apparatus in which the scanning is performed in such a manner that two lines are selected simultaneously with a one-line overlap, the present invention is not limited to such a case. For example, the present invention can similarly be applied to a display apparatus that employs a scanning method in which three or more lines are selected simultaneously with an overlap of two or more lines; that is, a plurality of lines are selected simultaneously with an overlap of lines of a number that is a half or more of the number of simultaneously selected lines.

Although the present invention is suitably applied to the case that the above scanning method is applied to a passive matrix display panel, the present invention is not limited to such a case. That is, the present invention can also be applied to the case of using an active matrix display panel.

The image display apparatus according to the present invention need not always perform scanning in the overlap scanning mode. The image display apparatus may be such that a scanning mode in which one line is selected each time in order is also prepared and switching is selectively made between the scanning modes according to a user's selection as shown in FIG. 3.

As described above, the present invention makes it possible to produce a good displayed image by compensating, in an optimum manner, for a deterioration of a vertical spatial frequency response characteristic in a middle/high-frequency range that is caused by the overlap scanning mode, and to thereby provide a bright, high-image-quality image display apparatus at a low cost.

What is claimed is:

1. An image signal processing apparatus to be used for an image display apparatus provided with a display panel having scan-wiring lines, modulation lines, and display elements that are driven via said scan-wiring lines and modulation lines; a scanning circuit for supplying scanning signals to said scan-wiring lines according to such a scanning method as to select a plurality of adjoining scan-wiring lines simultaneously in each selection period while changing the set of scan-wiring lines to be selected simultaneously so that the same scan-wiring line is selected two or more times in each frame; and a modulation circuit for supplying modulation signals to said modulation lines, wherein:

said image signal processing apparatus comprises filter means for performing, on received image data, signal processing for compensating for a reduction in resolution in a vertical scanning direction that is caused by said scanning method of said scanning circuit, and for supplying resulting image data to said modulation circuit; and a normalized vertical spatial frequency response characteristic of said filter means satisfies 0 dB<G1≦+6 dB, where G1 is a gain at a spatial frequency corresponding to ½ of a vertical critical resolution of said display panel.

2. The image signal processing apparatus according to claim 1, wherein said normalized vertical spatial frequency response characteristic of said filter means satisfies G2≧+3 dB, where G2 is a gain at a spatial frequency corresponding to 7/10 of said vertical critical resolution of said display panel.

3. An image display apparatus comprising:

a display panel having scan-wiring lines, modulation lines, and display elements that are driven via said scan-wiring lines and modulation lines;

a scanning circuit for supplying scanning signals to said scan-wiring lines according to such a scanning method as to select a plurality of adjoining scan-wiring lines simultaneously in each selection period while changing the set of scan-wiring lines to be selected simultaneously so that the same scan-wiring line is selected two or more times in each frame;

a modulation circuit for supplying modulation signals to said modulation lines; and filter means for performing, on received image data, signal processing for compensating for a reduction in resolution in a vertical scanning direction that is caused by said scanning method of said scanning circuit, and for supplying resulting image data to said modulation circuit, wherein a normalized vertical spatial frequency response characteristic of said image display apparatus satisfies −3 dB<R1≦+3 dB, where R1 is a response at a spatial frequency corresponding to ½ of a vertical critical resolution of said display panel.

4. The image display apparatus according to claim 3, wherein said display panel comprises electron-emitting elements as display elements located at crossing points of said scan-wiring lines and said modulation lines, and a phosphor that emits light when electrons emitted from said electron-emitting elements collide with it.

5. The image display apparatus according to claim 4, wherein said electron-emitting elements are surface conduction electron-emitting elements.

6. The image display apparatus according to claim 4, wherein said electron-emitting elements are FE electron-emitting elements.

7. An image signal processing method for processing image signals to be supplied to an image display apparatus having a modulation circuit for supplying modulation signals to modulation lines of a display panel and a scanning circuit for supplying scanning signals to scan-wiring lines of said display panel in such a manner as to select a plurality of adjoining scan-wiring lines simultaneously in each selection period while changing the set of scan-wiring lines to be selected simultaneously so that the same scan-wiring line is selected two or more times in each frame, said image signal processing method comprising:

a filtering step of performing, on received image data, signal processing for compensating for a reduction in resolution in a vertical scanning direction that is caused by said scanning circuit, and supplying resulting image data to said modulation circuit, wherein a normalized vertical spatial frequency response characteristic of said filtering step satisfies 0 dB<G1≦+6 dB, where G1 is a gain at a spatial frequency corresponding to ½ of a vertical critical resolution of said display panel.

8. The image signal processing method according to claim 7, wherein said normalized vertical spatial frequency response characteristic of said filtering step satisfies G2≧+3 dB, where G2 is a gain at a spatial frequency corresponding to 7/10 of said vertical critical resolution of said display panel.

9. An image display method using an image display apparatus having a scanning circuit for supplying scanning signals to scan-wiring lines of a display panel and a modulation circuit for supplying modulation signals to modulation lines of said display panel, said image display method comprising:

a scanning step of causing said scanning circuit to select a plurality of adjoining scan-wiring lines simultaneously in each selection period while changing the set of scan-wiring lines to be selected simultaneously so that the same scan-wiring line is selected two or more times in each frame; and a filtering step of performing, on received image data, signal processing for compensating for a reduction in resolution in a vertical scanning direction that is caused by said scanning step, and supplying resulting image data to said modulation circuit, wherein a normalized vertical spatial frequency response characteristic of said image display apparatus satisfies $-3\ \text{dB} < R1 \leqq +3\ \text{dB}$, where R1 is a response at a spatial frequency corresponding to ½ of a vertical critical resolution of said display panel.

* * * * *

UNITED STATES PATENT AND TRADEMARK OFFICE

CERTIFICATE OF CORRECTION

PATENT NO. : 7,218,316 B2
APPLICATION NO. : 10/762252
DATED : May 15, 2007
INVENTOR(S) : Muneki Ando It is certified that error appears in the above-identified patent and that said Letters Patent is hereby corrected as shown below:

COLUMN 2:

Line 12, “input” should read --inputs--.
Line 13, “S3 performs” should read --S3, performs--.
Line 16, “that” should read --in which--.

Signed and Sealed this

Third Day of February, 2009

John Doll

JOHN DOLL
*Acting Director of the United States Patent and Trademark Office*